US011660871B2

(12) United States Patent
Song et al.

(10) Patent No.: US 11,660,871 B2
(45) Date of Patent: May 30, 2023

(54) REPAIR CHIP, INK CARTRIDGE, AND PRINTER

(71) Applicant: HANGZHOU CHIPJET TECHNOLOGY CO., LTD., Hangzhou (CN)

(72) Inventors: Jie Song, Hangzhou (CN); Yuanjie Yu, Hangzhou (CN)

(73) Assignee: HANGZHOU CHIPJET TECHNOLOGY CO., LTD., Hangzhou (CN)

( * ) Notice: Subject to any disclaimer, the term of this patent is extended or adjusted under 35 U.S.C. 154(b) by 145 days.

(21) Appl. No.: 17/424,559

(22) PCT Filed: Dec. 11, 2020

(86) PCT No.: PCT/CN2020/135635
§ 371 (c)(1),
(2) Date: Jul. 21, 2021

(87) PCT Pub. No.: WO2021/115421
PCT Pub. Date: Jun. 17, 2021

(65) Prior Publication Data

US 2022/0072863 A1 Mar. 10, 2022

(30) Foreign Application Priority Data

Dec. 13, 2019 (CN) ..... 201922234380.6

(51) Int. Cl.
*B41J 2/175* (2006.01)

(52) U.S. Cl.
CPC ..... *B41J 2/1753* (2013.01); *B41J 2/17546* (2013.01); *B41J 2/17553* (2013.01); *B41J 2/17559* (2013.01)

(58) Field of Classification Search
CPC .. B41J 2/1753; B41J 2/17546; B41J 2/17553; B41J 2/17559
(Continued)

(56) References Cited

U.S. PATENT DOCUMENTS

2014/0225946 A1* 8/2014 Quinn ..... B41J 2/17559 347/7
2018/0224787 A1* 8/2018 Zhang ..... G06F 13/00
(Continued)

FOREIGN PATENT DOCUMENTS

CN 204472118 U 7/2015
CN 204749526 U 11/2015
(Continued)

OTHER PUBLICATIONS

ISR of PCT/CN2020/135635.
The extended European search report of EP20899508.4.

*Primary Examiner* — Matthew Luu
*Assistant Examiner* — Alexander D Shenderov

(57) ABSTRACT

A repair chip, an ink cartridge, and a printer are provided. In the repair chip, a first surface of a substrate is provided with a first contact point and a second contact point. A repair resistor, a first tin point, and a second tin point are provided on a second surface of the substrate. Each of the first tin point and the second tin point is connected to both ends of the repair resistor. Each of the first contact point and the second contact point is electrically connected to the printer. The first contact point is connected to the first tin point, and the second contact point is connected to the second tin point; each of the first tin point and the second tin point is connected to the chip contact points of an ink cartridge chip.

11 Claims, 3 Drawing Sheets

(58) Field of Classification Search
USPC ..... 347/50
See application file for complete search history.

(56) References Cited

U.S. PATENT DOCUMENTS

| | | | | |
|---|---|---|---|---|
| 2018/0246688 | A1* | 8/2018 | Wang | G06F 3/1219 |
| 2021/0187960 | A1* | 6/2021 | Gao | B41J 2/17559 |

FOREIGN PATENT DOCUMENTS

| | | | |
|---|---|---|---|
| CN | 106240161 | A | 12/2016 |
| CN | 105538916 | B | 10/2017 |
| CN | 109572222 | A | 4/2019 |
| CN | 110053362 | A | 7/2019 |
| CN | 211942586 | U | 11/2020 |
| EP | 3369577 | A1 | 9/2018 |
| WO | WO2018113706 | A1 | 6/2018 |

* cited by examiner

REPAIR CHIP, INK CARTRIDGE, AND PRINTER

CROSS REFERENCE TO RELATED APPLICATIONS

This application is a National Stage application of International application No. PCT/CN2020/135635, filed on Dec. 11, 2020, which claims all benefits of the priority from China Patent Application No. 201922234380.6, filed on Dec. 13, 2019, in the China National Intellectual Property Administration, the content of which is hereby incorporated by reference.

TECHNICAL FIELD

The present disclosure generally relates to a technical field of a printing device, and in particular, to a repair chip, an ink cartridge, and a printer.

BACKGROUND

An ink cartridge is a member of an inkjet printer, which is used to store ink for printing and then complete the printing. The ink cartridge can be an integrated ink cartridge with a head or a splitting ink cartridge. The integrated ink cartridge integrates a nozzle on the cartridge. When the ink runs out and the integrated ink cartridge needs to be replaced, the nozzle will be replaced accordingly. Therefore, high printing accuracy and printing quality can be achieved, but the cost of the integrated ink cartridge is relatively high. In order to reduce the cost of the integrated ink cartridge, a used ink cartridge can be recycled and reused. In generally, a recycled ink cartridge is usually an old ink cartridge that cannot be used immediately due to damage of a resistance of a chip on the ink cartridge. As a result, the ink cartridge is often scrapped and cannot be used again.

There is no effective solution yet to solve this problem of low utilization rate of the recycled ink cartridge.

SUMMARY

According to embodiments of the present disclosure, a repair chip is provided, which can be applied to an ink cartridge. The repair chip includes a substrate, a first contact point, a second contact point, a first tin point, a second tin point and a repair resistor. The substrate has a first surface and a second surface opposite to each other. The first contact point and the second contact point are located on the first surface. The first tin point, the second tin point and the repair resistor are located on the second surface. The first tin point is corresponding to the first contact point, and the second tin point is corresponding to the second contact point. The first tin point is connected with a first end of the repair resistor, and the second tin point is connected with a second end of the repair resistor. The first contact point and the second contact point are configured for electrically connecting with a printer, respectively. The first contact point is connected with the first tin point, and the second contact point is connected with the second tin point. The first tin point and the second tin point are configured to connect with chip contact points of a chip of the ink cartridge, respectively. The second surface is bonded to a surface of the chip of the ink cartridge.

In an embodiment of the present disclosure, the chip contact points of the chip include a contact point to be repaired and a grounding contact point. The first tin point is connected with the contact point to be repaired, and the second tin point is connected with the grounding contact point.

In an embodiment of the present disclosure, the repair resistor is embedded in a first groove disposed on the ink cartridge.

In an embodiment of the present disclosure, a thickness of the repair resistor matches a depth of the first groove.

In an embodiment of the present disclosure, the second surface is further provided with a chip crystal, and the chip crystal is embedded in a second groove disposed on the ink cartridge.

In an embodiment of the present disclosure, the repair resistor is embedded in a first groove disposed on the ink cartridge, and the second groove and the first groove are the same one.

In an embodiment of the present disclosure, the first contact point is connected with the first tin point via a through hole filled with a conductor, and the second contact point is connected with the second tin point via a through hole filled with a conductor.

In an embodiment of the present disclosure, the repair chip is provided with a locating portion. The locating portion includes a hole structure or a groove structure. The locating portion is configured to preposition the substrate when mounting the repair chip. The ink cartridge is provided with a positioning seat, and the locating portion coincides with a center of the positioning seat.

In an embodiment of the present disclosure, the substrate is a flexible substrate.

According to embodiments of the present disclosure, an ink cartridge is further provided. The ink cartridge includes an ink cartridge body, a chip of the ink cartridge and a repair chip. The repair chip includes a substrate, a first contact point, a second contact point, a first tin point, a second tin point and a repair resistor. The substrate has a first surface and a second surface opposite to each other. The first contact point and the second contact point are located on the first surface. The first tin point, the second tin point and the repair resistor are located on the second surface. The first tin point is corresponding to the first contact point, and the second tin point is corresponding to the second contact point. The first tin point is connected with a first end of the repair resistor, and the second tin point is connected with a second end of the repair resistor. The first contact point and the second contact point are configured for electrically connecting with a printer, respectively. The first contact point is connected with the first tin point, and the second contact point is connected with the second tin point. The ink cartridge body is connected with the chip of the ink cartridge. The first tin point and the second tin point are configured to connect with chip contact points of a chip of the ink cartridge, respectively. The second surface is bonded to a surface of the chip of the ink cartridge.

In an embodiment of the present disclosure, the chip contact points of the chip of the ink cartridge include a contact point to be repaired and a grounding contact point. The first tin point is connected with the contact point to be repaired, and the second tin point is connected with the grounding contact point.

In an embodiment of the present disclosure, the ink cartridge is provided with a first groove, and the repair resistor is embedded in the first groove.

According to embodiments of the present disclosure, a printer is further provided. The printer includes a printer body, an ink cartridge body, a chip of the ink cartridge and a repair chip. The repair chip includes a substrate, a first contact point, a second contact point, a first tin point, a second tin point and a repair resistor. The substrate has a first surface and a second surface opposite to each other. The first contact point and the second contact point are located on the first surface. The first tin point, the second tin point and the repair resistor are located on the second surface. The first tin point is corresponding to the first contact point, and the second tin point is corresponding to the second contact point. The first tin point is connected with a first end of the repair resistor, and the second tin point is connected with a second end of the repair resistor. The first contact point and the second contact point are configured for electrically connecting with the printer body, respectively. The first contact point is connected with the first tin point, and the second contact point is connected with the second tin point. The ink cartridge body is connected with the chip of the ink cartridge. The first tin point and the second tin point are configured to connect with chip contact points of the chip of the ink cartridge, respectively. The second surface is bonded to a surface of the chip of the ink cartridge.

The above repair chip, ink cartridge and printer have the following advantages: the repair resistor is located on the repair chip, the contact points are located on the first surface of the substrate, the tin points corresponding to the contact points are located on the second surface of the substrate, the repair resistor is connected with the tin points, and the tin points are connected with the chip contact points of the chip of the ink cartridge. As a result, a damaged resistor of the chip of the ink cartridge can be repaired, the recycled ink cartridge can be used normally after filling ink, and the utilization rate of the recycled ink cartridge is improved.

BRIEF DESCRIPTION OF THE DRAWINGS

To describe and illustrate embodiments and/or examples of the present disclosure made public here better, reference may be made to one or more of the figures. The additional details or examples used to describe the figures should not be construed as limiting the scope of any of the present disclosure, the embodiments and/or examples currently described, and the best model of the present disclosure as currently understood.

In the figures, 100 represents a repair chip, 10 represents a substrate, 12 represents a first surface, 22 represents a second surface, 14 represents a first contact point, 16 represents a second contact point, 24 represents a first tin point, 26 represents a second tin point, 28 represents a repair resistor, 30 represents a locating portion, 40 represents a chip crystal, 110 represents an ink cartridge body, 120 represents a chip of an ink cartridge, 52 represents a first groove, and 62 represents a printer body.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

It should be understood that in the description of the present disclosure, an orientation or a position relationship indicated by location words such as "center, up, down, left, right, vertical, horizontal, inside and outside" are based on an orientation or a position relationship shown in the attached figures, which is only for the convenience of describing the present disclosure and simplifying the description. These location words do not indicate and imply that the device or element referred to must have a specific orientation or be constructed and operated in a specific orientation, so it cannot be understood as a restriction on the scope of the present disclosure. Furthermore, the terms "first", "second" and "third" are used only for descriptive purposes and cannot be understood to indicate or imply relative importance.

In the description of the present disclosure, it should be noted that unless otherwise expressly stated and qualified, the terms "disposed", "joined" and "connected" are to be understood broadly. For example, the connection can be a fixed connection, a detachable connection, or an integrated connection. It can also be a mechanical connection or an electrical connection. It can be a direct connection or an indirect connection through an intermediary. It can be an internal connection of two components. The specific meaning of the above terms in the present disclosure may be understood on a case-by-case basis by the skilled in the art.

Unless otherwise defined, all technical and scientific terms used herein have the same meaning as a skilled person in the art would understand. The terminology used in the description of the present disclosure is for the purpose of describing particular embodiments and is not intended to limit the present disclosure.

Figure 1:
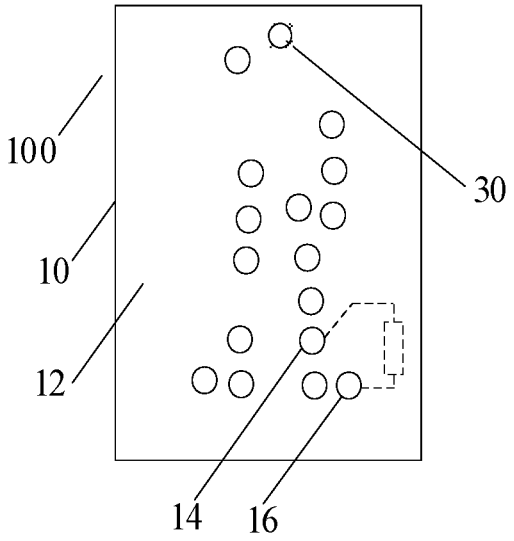
FIG. 1 is a schematic diagram of a first surface of a repair chip in an embodiment of the present disclosure.
Figure 2:
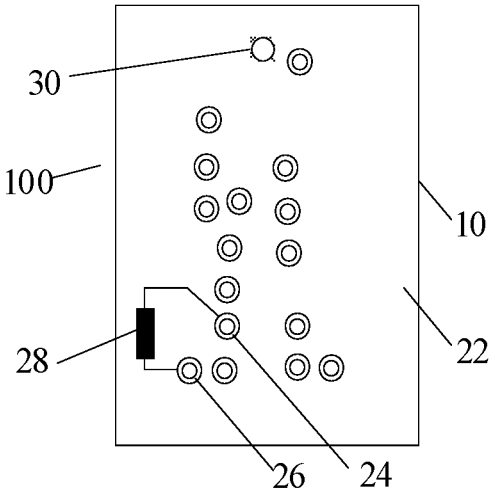
FIG. 2 is a schematic diagram of a second surface of a repair chip in an embodiment of the present disclosure.

In an embodiment, a repair chip applied to an ink cartridge is provided. FIG. 1 is a schematic diagram of a first surface of a repair chip in an embodiment of the present disclosure. FIG. 2 is a schematic diagram of a second surface of a repair chip in an embodiment of the present disclosure. As shown in FIG. 1 and FIG. 2, the repair chip 100 includes a substrate 10, a first contact point 14, a second contact point 16, a first tin point 24, a second tin point 26 and a repair resistor 28. The substrate 10 has a first surface 12 and a second surface 22 opposite to each other. The first contact point 14 and the second contact point 16 are located on the first surface 12. The first contact point 14 is corresponding to a contact point to be repaired, which is connected with a damaged resistor on a chip 120 of the ink cartridge. A detection method of the contact point to be repaired includes: the ink cartridge can be mounted in a printer, and the conductivity of multiple contact points on the chip 120 of the ink cartridge can be detected by the printer. If a pull-down resistance connected with the contact point on the chip 120 of the ink cartridge is too large or damaged, the printer will not pass a detection. Alternatively, the pull-down resistance can be judged by measuring a resistance value between two contact points on the chip 120 of the ink cartridge, so as to determine the contact point to be repaired.

The first tin point 24, the second tin point 26 and the repair resistor 28 are located on the second surface 22. The first tin point 24 is corresponding to the first contact point 14, and the second tin point 26 is corresponding to the second contact point 16. The first tin point 24 is connected with a first end of the repair resistor 28, and the second tin point 26 is connected with a second end of the repair resistor 28. The first contact point 14 and the second contact point 16 are configured for electrically connecting with the printer, respectively. The first contact point 14 is connected with the first tin point 24, and the second contact point 16 is connected with the second tin point 26. The first contact point 14 can be connected with the first tin point 24 via a through hole filled with a conductor provided on the substrate 10 along a thickness direction of the substrate 10. The first contact point 14 can be connected with the first tin point 24 through a wiring layer on the substrate 10. It is understood that the second contact point 16 can also be connected with the second tin point 26 in the manner described above.

The first tin point 24 and the second tin point 26 are configured to connect with chip contact points of the chip 120 of the ink cartridge, respectively. The connection mode can be welding. The tin points and the chip contact points are welded through a welding device. A number of the tin points and a number of the chip contact points are the same, and an arrangement of the tin points is corresponding to an arrangement of the chip contact points. The second surface 22 of the substrate 10 is bonded to a surface of the chip 120 of the ink cartridge. After the ink cartridge is regenerated, the repair of the chip 120 of the ink cartridge can be judged by using the printer again for verification.

In the above embodiment, the repair resistor 28 is located on the repair chip 100, the contact points are located on the first surface 12 of the substrate 10, the tin points corresponding to the contact points are located on the second surface 22 of the substrate 10, the repair resistor 28 is connected with the tin points, and the tin points are connected with the chip contact points of the chip 120 of the ink cartridge. As a result, a damaged resistor of the chip 120 of the ink cartridge can be repaired, the recycled ink cartridge can be normally used after filling ink, and the utilization rate of the recycled ink cartridge is improved. At the same time, the repair chip 100 does not contain a crystal and a cost of the repair chip 100 is low.

In an embodiment, the chip contact points of the chip 120 of the ink cartridge include a contact point to be repaired and a grounding contact point. The first tin point 24 is connected with the contact point to be repaired, and the second tin point 26 is connected with the grounding contact point. The contact point to be repaired can be a contact point connected with the damaged resistor on the chip 120 of the ink cartridge, and the contact point to be repaired can be one or more.

In an embodiment, the repair resistor 28 is embedded in a first groove 52 disposed on the ink cartridge. At the same time, a thickness of the repair resistor 28 matches a depth of the first groove 52, resulting in that the repair resistor 28 can be inserted into the first groove 52 to avoid extrusion or damage to the surface of the repair chip 100 applied to the ink cartridge. The first groove 52 disposed on the ink cartridge can be distributed on one side of the chip 120 of the ink cartridge, resulting in that multiple repair resistors 28 can be embedded in the first groove 52, avoiding repeating the groove on the ink cartridge when multiple repair resistors 28 are disposed on the repair chip 100.

Figure 3:
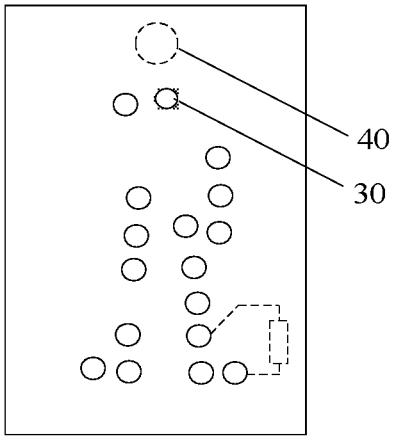
FIG. 3 is a schematic diagram of a first surface of another repair chip in another embodiment of the present disclosure.
Figure 4:
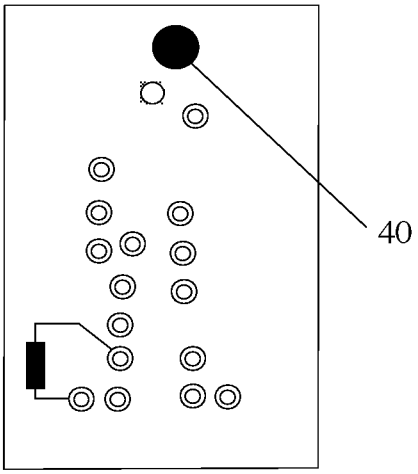
FIG. 4 is a schematic diagram of a second surface of another repair chip in another embodiment of the present disclosure.

In an embodiment, FIG. 3 is a schematic diagram of a first surface of another repair chip in an embodiment of the present disclosure. FIG. 4 is a schematic diagram of a second surface of another repair chip in an embodiment of the present disclosure. As shown in FIG. 3 and FIG. 4, the second surface 22 of the repair chip 100 is further provided with a chip crystal 40, and the chip crystal 40 is embedded in a second groove disposed on the ink cartridge. A thickness of the chip crystal 40 matches a depth of the second groove. In addition, the second groove and the first groove 52 can be the same one, i.e., the chip crystal 40 may also share a groove with the repair resistor 28. The repair chip 100 can be applied to the ink cartridge where part of the data carried by the crystal of the chip 120 of the ink cartridge is lost, resulting in that the chip crystal 40 can replace at least the part of the lost data and the ink cartridge can continue to be used normally.

In an embodiment, the repair chip 100 is provided with a locating portion 30. The locating portion 30 includes a hole structure or a groove structure. The locating portion 30 is located on the top of the substrate 10. A number of the locating portions 30 can also be two, and the two locating portions 30 are located on both sides of the substrate 10, respectively. Of course, the number of the locating portions 30 can be set according to the actual needs, and the present disclosure does not make excessive restrictions.

The locating portion 30 is configured to preposition the substrate 10 when mounting the repair chip 100. Specifically, the locating portion 30 locates a coding writing device and the repair chip 100 when the coding writing device writes codes to the repair chip 100. The ink cartridge is provided with a positioning seat, and the locating portion 30 is disposed to coincide with a center of the positioning seat. The locating portion 30 is coordinated with the positioning seat, resulting in that the repair chip 100 is fixedly connected with the ink cartridge.

In an embodiment, the substrate is a flexible substrate. The flexible substrate can be made of a soft material such as polyimide or polyester film, resulting in that the substrate 10 has a certain flexibility.

Figure 5:
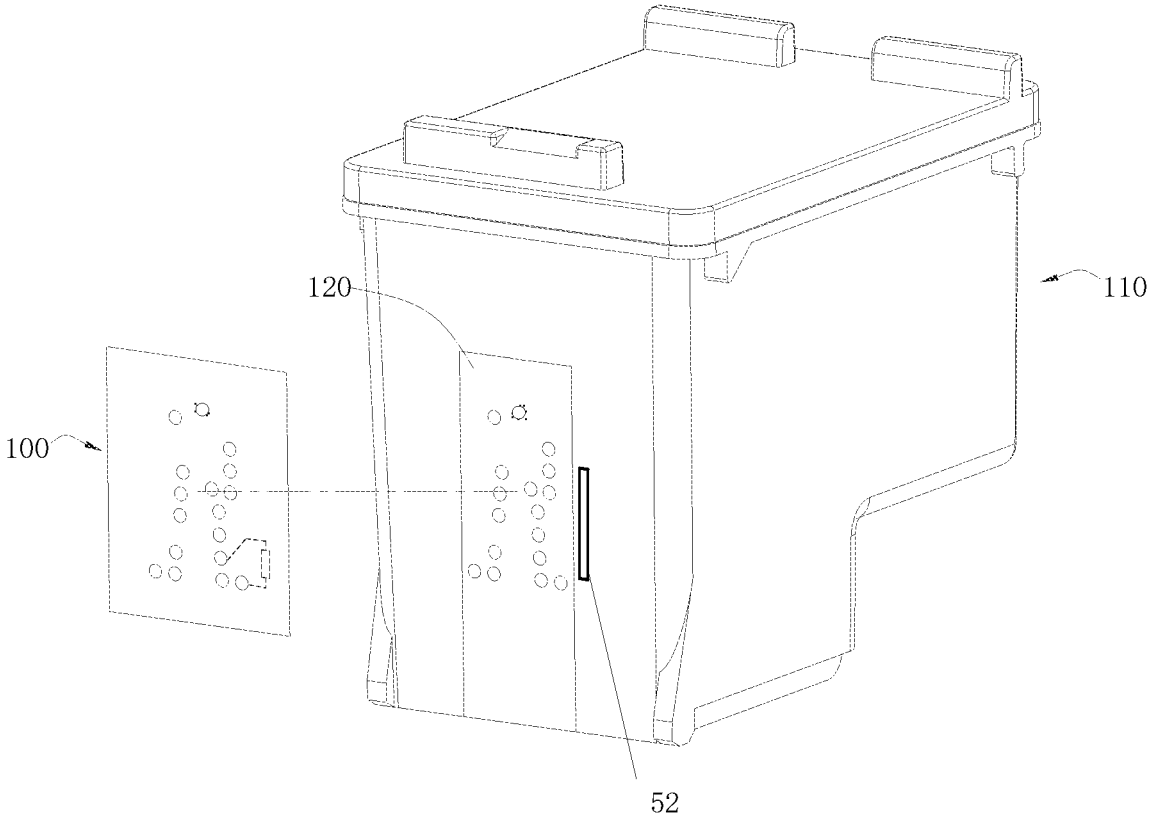
FIG. 5 is a schematic diagram of an ink cartridge in another embodiment of the present disclosure.

In another embodiment, an ink cartridge is provided. FIG. 5 is a schematic diagram of an ink cartridge in an embodiment of the present disclosure. As shown in FIG. 5, the ink cartridge includes an ink cartridge body 110, a chip 120 of the ink cartridge and a repair chip 100. The repair chip 100 includes a substrate 10, a first contact point 14, a second contact point 16, a first tin point 24, a second tin point 24 and a repair resistor 28. The substrate 10 has a first surface 12 and a second surface 22 opposite to each other. The first contact point 14 and the second contact point 16 are located on the first surface 12. The first tin point 24, the second tin point 26 and the repair resistor 28 are located on the second surface 22. The first tin point 24 is corresponding to the first contact point 14, and the second tin point 26 is corresponding to the second contact point 16. The first tin point 24 is connected with a first end of the repair resistor 28, and the second tin point 26 is connected with a second end of the repair resistor 28. The first contact point 14 and the second contact point 16 are configured for electrically connecting with a printer, respectively. The first contact point 14 is connected with the first tin point 24, and the second contact point 16 is connected with the second tin point 26. The ink cartridge body 110 is provided with a first groove 52, and the first groove 52 can be embedded in the repair resistors 28 and/or chip crystals 40. The ink cartridge body 110 is connected with the chip 120 of the ink cartridge. The first tin point 24 and the second tin point 26 are configured to connect with chip contact points of the chip 120 of the ink cartridge, respectively. The second surface 22 of the substrate 10 is bonded to a surface of the chip 120 of the ink cartridge. After the ink cartridge is regenerated, the repair of the chip 120 of the ink cartridge can be judged by using the printer again for verification.

In an embodiment, the chip contact points of the chip 120 of the ink cartridge include a contact point to be repaired and a grounding contact point. The first tin point 24 is connected with the contact point to be repaired, and the second tin point 26 is connected with the grounding contact point.

Figure 6:
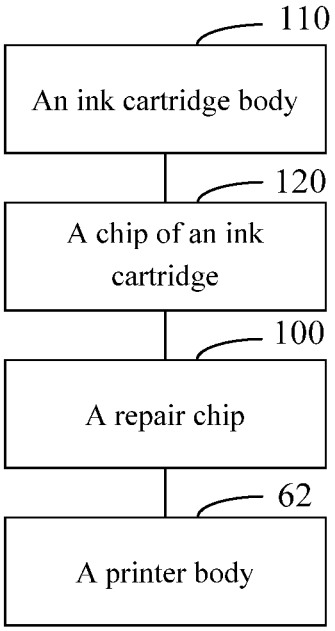
FIG. 6 is a block diagram of a printer in another embodiment of the present disclosure.

In another embodiment, a printer is provided. FIG. 6 is a block diagram of a printer in an embodiment of the present disclosure. As shown in FIG. 6, the printer includes a printer body 62, an ink cartridge body 110, a chip 120 of the ink cartridge and a repair chip 100. The repair chip 100 includes a substrate 10, a first contact point 14, a second contact point 16, a first tin point 24, a second tin point 24 and a repair resistor 28. The substrate 10 has a first surface 12 and a second surface 22 opposite to each other. The first contact point 14 and the second contact point 16 are located on the first surface 12 of the substrate 10. The first tin point 24, the second tin point 26 and the repair resistor 28 are located on the second surface 22 of the substrate 10. The first tin point 24 is corresponding to the first contact point 14, and the second tin point 26 is corresponding to the second contact point 16. The first tin point 24 is connected with a first end of the repair resistor 28, and the second tin point 26 is connected with a second end of the repair resistor 28. The first contact point 14 and the second contact point 16 are configured for electrical connection with the printer body 62, respectively. The first contact point 14 is connected with the first tin point 24, and the second contact point 16 is connected with the second tin point 26. The ink cartridge body 110 is connected with the chip 120 of the ink cartridge. The first tin point 24 and the second tin point 26 are configured to connect with chip contact points of the chip 120 of the ink cartridge, respectively. The second surface 22 of the substrate 10 is bonded to a surface of the chip 120 of the ink cartridge.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a plurality of variations and modifications may be made by those skilled in the art without departing from the spirit and scope of the disclosure. Therefore, the scope of the disclosure should be determined by the appended claims.

We claim:

1. A repair chip applied to an ink cartridge, wherein the repair chip comprises a substrate, a first contact point, a second contact point, a first tin point, a second tin point and a repair resistor;

the substrate has a first surface and a second surface opposite to each other;

the first contact point and the second contact point are located on the first surface;

the first tin point, the second tin point and the repair resistor are located on the second surface, the first tin point is corresponding to the first contact point, the second tin point is corresponding to the second contact point, the first tin point is connected with a first end of the repair resistor, and the second tin point is connected with a second end of the repair resistor;

the first contact point and the second contact point are configured for electrically connecting with a printer, respectively; the first contact point is connected with the first tin point, and the second contact point is connected with the second tin point;

the first tin point and the second tin point are configured to connect with chip contact points of a chip of the ink cartridge, respectively; and the second surface is bonded to a surface of the chip of the ink cartridge.

2. The repair chip of claim 1, wherein the chip contact points of the chip comprise a contact point to be repaired and a grounding contact point, the first tin point is connected with the contact point to be repaired, and the second tin point is connected with the grounding contact point.

3. The repair chip of claim 1, wherein the repair resistor is embedded in a first groove disposed on the ink cartridge.

4. The repair chip of claim 3, wherein a thickness of the repair resistor matches a depth of the first groove.

5. The repair chip of claim 1, wherein the second surface is further provided with a chip crystal, and the chip crystal is embedded in a second groove disposed on the ink cartridge.

6. The repair chip of claim 5, wherein the repair resistor is embedded in a first groove disposed on the ink cartridge, and the second groove and the first groove are the same one.

7. The repair chip of claim 1, wherein the first contact point is connected with the first tin point via a through hole filled with a conductor, and the second contact point is connected with the second tin point via a through hole filled with a conductor.

8. The repair chip of claim 1, wherein the repair chip is provided with a locating portion; the locating portion comprises a hole structure or a groove structure;

the locating portion is configured to preposition the substrate when mounting the repair chip; the ink cartridge is provided with a positioning seat, and the locating portion coincides with a center of the positioning seat.

9. The repair chip of claim 1, wherein the substrate is a flexible substrate.

10. An ink cartridge, wherein the ink cartridge comprises an ink cartridge body, a chip of the ink cartridge and a repair chip;

the repair chip comprises a substrate, a first contact point, a second contact point, a first tin point, a second tin point and a repair resistor;

the substrate has a first surface and a second surface opposite to each other;

the first surface is provided with the first contact point and the second contact point;

the second surface is provided with the repair resistor, the first tin point corresponding to the first contact point, and the second tin point corresponding to the second contact point; the first tin point is connected with a first end of the repair resistor, and the second tin point is connected with a second end of the repair resistor;

the first contact point and the second contact point are configured for electrical connection with a printer, respectively; the first contact point is connected with the first tin point, and the second contact point is connected with the second tin point;

the ink cartridge body is connected with the chip of the ink cartridge; the first tin point and the second tin point are configured to connect with chip contact points of the chip of the ink cartridge, respectively; and the second surface is bonded to a surface of the chip of the ink cartridge.

11. A printer, wherein the printer comprises a printer body, an ink cartridge body, a chip of the ink cartridge and a repair chip;

the repair chip comprises a substrate, a first contact point, a second contact point, a first tin point, a second tin point and a repair resistor;

the substrate has a first surface and a second surface opposite to each other;

the first contact point and the second contact point are located on the first surface;

the first tin point, the second tin point and the repair resistor are located on the second surface, the first tin point is corresponding to the first contact point, the second tin point is corresponding to the second contact point, the first tin point is connected with a first end of the repair resistor, and the second tin point is connected with a second end of the repair resistor;

the first contact point and the second contact point are configured for electrically connecting with a printer, respectively; the first contact point is connected with the first tin point, and the second contact point is connected with the second tin point;

the first tin point and the second tin point are configured to connect with chip contact points of a chip of the ink cartridge, respectively; and the second surface is bonded to a surface of the chip of the ink cartridge.

* * * * *